US005287778A

United States Patent [19]

Cook

[11] Patent Number: 5,287,778

[45] Date of Patent: Feb. 22, 1994

[54] UNIVERSAL SCREW DRIVER

[76] Inventor: Steven M. Cook, 3 Savannah Dr., Sylva, N.C. 28779

[21] Appl. No.: 769,717

[22] Filed: Oct. 2, 1991

[51] Int. Cl.[5] ..... B25B 23/10

[52] U.S. Cl. ..... 81/442; 81/185; 81/460; 269/266

[58] Field of Search ..... 81/185, 436, 442, 460; 269/266

[56] References Cited

U.S. PATENT DOCUMENTS

| | | | |
|---|---|---|---|
| 1,896,949 | 2/1933 | Greiner | 81/185 |
| 3,127,798 | 4/1964 | Gol | 81/185 X |
| 3,674,070 | 7/1972 | Mahoney | 81/442 |
| 3,858,467 | 1/1975 | Pasbrig | 81/185 |
| 3,895,828 | 7/1975 | Bitantis | 81/185 X |
| 4,887,498 | 12/1989 | Zayat | 81/185 |

*Primary Examiner*—James G. Smith
*Attorney, Agent, or Firm*—George R. Royer

[57] ABSTRACT

The subject apparatus is an improved screw driver adapted to have an expanding head to adapt to different screw head types and sizes, such screw driver device apparatus comprising a hollow handle member affixed concentrically to a hollow shaft, with the hollow shaft member holding a plurality of movable rod members that are adapted to move axially and longitudinally, within a limited distance in such hollow shaft member towards the head of the screw driver to move the ends thereof into position on the head of the screw.

3 Claims, 2 Drawing Sheets

UNIVERSAL SCREW DRIVER

KNOWN PRIOR ART

The subject invention is an improved screw driver having integral shaft and blade means that are both expandable and contractible in such a manner to permit the screw driver blade to properly adjust to and seat into the slots or slot in the head. This arrangement is conceived to permit a single screw driver to be utilized on any type of screw head, irrespective of the size or configuration of the screw head whether a screw having a flat head, Phillips head, hexagonal head, torque head, square head, allen type head, or otherwise. Therefore, the subject apparatus us usable on conventional, single-slotted screw heads or other types of screw heads. In brief, the subject screw driver arrangement is a universal screw driver that will adapt to all types of screw heads.

In this latter respect, it is obvious from a review of the existing art, and the array of devices seen, that the Phillips type screw driver is structured to be used on screws having two crossed slots, while a single-bladed screw driver is structured to be used on single-slotted heads. Other types of screw heads, as set forth above, require different types of screw driver shaft ends for functional use. There is very minimal interchangeability of usage between such types of screw drivers and the different types of screw heads. As a consequence, there is a need for a type of screw driver device that is adaptable to be used on all types of screws, without the requirement of interchanging heads.

Additionally, since screw heads vary in size, there is a relatively wide range in the sizes of the slots that are formed on various screw heads. Consequently, there is a corresponding array of screw driver blade sizes needed to fit the various screw head slot sizes, as well as varying configurations. For this purpose, a range of screw drivers is usually obtained to meet these various type and size needs.

Thus, as can be observed, there is a need for a unitary screw driver head and blade end that would be universally adapted to all types of screw head configurations, slots, sizes, and other variations in the screw head. Moreover, there are no known screw driver devices conceived in the prior art that are structured to effectively adapt to varying size and configuration requirements of screw heads. This invention is conceived for the latter purpose and the following objects of the subject invention are set forth accordingly.

OBJECTS OF THE INVENTION

It is an object of the subject invention to provide a universal screw driver;

A further object of the subject invention is to provide a screw driver apparatus that automatically adapts itself to different types of screw head configurations and sizes;

Another object of the subject invention is to provide a screw driver that can be utilized on any type or size of screw head;

It is another object of the subject invention to provide a universal screw driver;

Still another object of the subject invention is to provide a versatile and novel screw driver blade end;

It is an object of the subject invention to provide a screw driver for universal use on all types of screw heads and sizes without the need of an interchange;

Other and further objects of the subject invention will become apparent from a reading of the following description taken in conjunction with the claims and drawings.

DESCRIPTION OF GENERAL EMBODIMENT AND SUMMARY OF INVENTION

Figure 1:
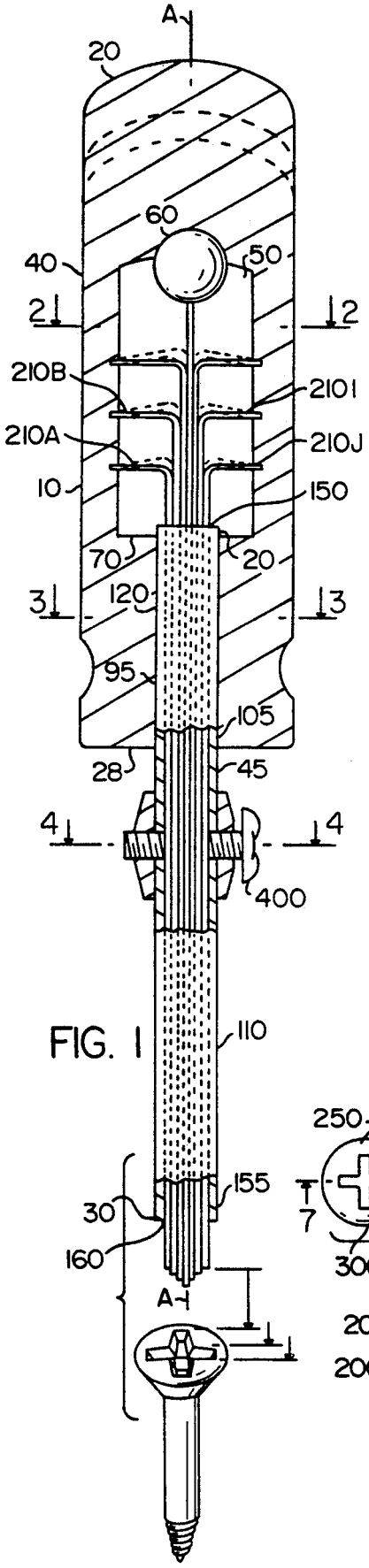
FIG. 1 is a side elevational view in section of the subject apparatus, shown in cross-sectional configuration, as showing the working end of the screw driver just prior to engagement with a screw head.
Figure 2:
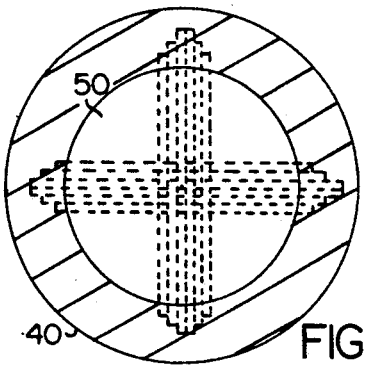
FIG. 2 is a cross elevational view of the subject screw driver apparatus through the sectional line 2—2 of FIG. 1.
Figure 3:
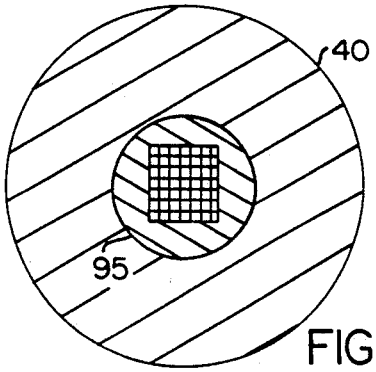
FIG. 3 is a cross-sectional view of the screw driver handle assembly, as shown through sectional line 3—3 of FIG. 1.
Figure 4:
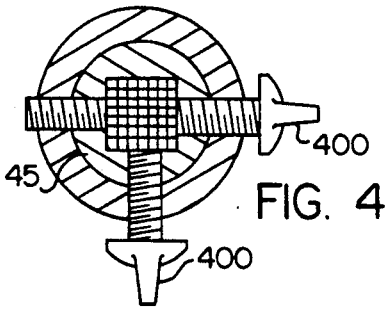
FIG. 4 is a cross-sectional view of the screw driver assembly as shown through sectional 4—4 of FIG. 1.
Figure 5:
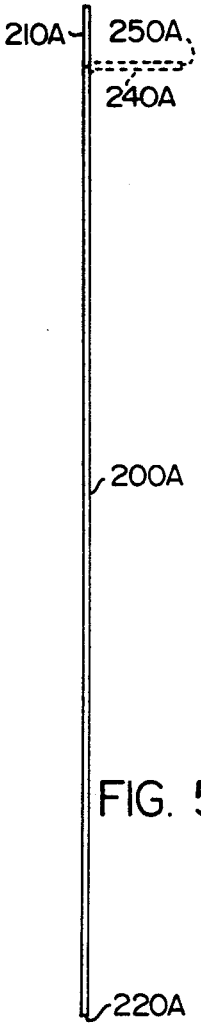
FIG. 5 is a side elevational view of a rod member used in the subject screw driver assembly.

The subject apparatus is a universal screw driver apparatus having an expanding head to adapt to different screw head sizes and configurations, said screw driver device apparatus comprising, in part, a hollow handle member affixed concentrically to a hollow shaft, with the hollow shaft member holding a plurality of movable rod members that are deployed and adapted to move axially longitudinally and a limited distance in such hollow shaft member, and are more specifically adapted to move independently of one another to seat the various ends of the rod members into position on the slots of the head of a screw driver. The thrust of the individual and multiple rod movements as described is to fully penetrade a given screw head configuration to enable the screw driver to turn a given screw.

Furthermore, the subject invention encompasses any screw driver or similar implement that may be used on screws and fasteners of various shapes and sizes in which there is a shaft ending that can be varied in shape, type or size by any means. In the most general embodiment of the subject invention, the screw driver has an interior hollow chambered portion which contains multiple longitudinally extending rod members, the ends of which form the screw driver blade tip which blade tip adapts to fit conformingly into a screw head slot or fasterner slot. These latter rod members are affixed in the hollow inner chamber in such a manner so as to be retractible within the hollow chamber. More specifically, each rod member is independently retractible inside the hollow chamber, and by this latter arrangement each rod member can move up and down, in an axial direction relative to one another so that the ends of the rods may reach different axial lengths relative to one another at the distal ends forming the screw driver blade tip. In this functional positioning of the ends of the rod members, it enables each respective rod member to seek the complete and full depth of the slot or slots, or cavity, or pattern of a given screw head, irrespective of type or configuration. The rod members are thus independently axially movable so that each end of the respective rod members seeks its own depth or level in the screw head and its slots or other arrangement. Thus, all such rod ends impinge into the slots or other fitting arrangements at variable distances and locations, depending on the exact portion of the screw head or its slot which a given rod end reaches and otherwise extends.

DESCRIPTION OF PREFERRED EMBODIMENT

In describing the preferred embodiment of the subject invention, it is to be noted that the subject invention may be encompassed in various embodiments. Therefore, the following description of one particular embodiment shall not be construed as limiting the scope of the subject invention as described in the claims hereto.

Referring now to the drawings in which a preferred embodiment is shown, a screw driver apparatus 10 is shown as incorporating the features of the subject invention. As can be seen, screw driver member 10 has a first end 20 and a second end 30. As seen in the drawings, and particularly FIG. 1, the screw driver member 10 has a longitudinal central axis which extends as the longitudinally extending concentric axis of the screw driver member 10. As seen in the drawings, the first end 20 is the upper end of the screw driver member 10, while the second end 30 is the lower end, as seen in upright position.

Shown in FIG. 1 is a screw driver 10 comprising elements which form the substance of the subject invention. Screw driver 10 as shown has the outward or external appearance, in most respects, of a conventional screw driver. More particularly, screw driver 10 is a longitudinally extending member having a first end 20 and a second end 30 with an imaginary longitudinal central axis A-A extending longitudinally and symmetrically through the longest extent of the screw driver from the first end 20 to the second end 30 thereof. The second end is the working end of the screw driver as more fully described below, which working end is the end of the shaft usually referred to as the blade tip.

As can be seen from the drawings, with particular reference to FIG. 1, the screw driver 10 has a cylindrical handle portion 40, which handle portion extends from the first end 20 of the screw driver 10 to a position disposed intermediately between the first end 20 and second end 30 of the screw driver. More specifically, screw driver handle portion 40 is shown as a generally cylindrically-shaped member, although its external configuration can be other than cylindrical. The fact that the handle member as shown and described herein is of a cylindrical configuration should not be construed in any manner as limiting the scope of the subject invention.

Further attention is directed to FIG. 1. The handle member 40 of the screw driver 10 is concentrically mounted to a screw driver shaft 45 in such a manner that the screw driver shaft 45 and the handle member 40 are both coaxially aligned, preferably along the imaginary longitudinal central axis A-A, as seen in FIG. 1. In this latter positional relationship, the screw driver shaft 45 extends coaxially outwardly from the second end 28 of the handle member, extending to the second end 30 of the screw driver 10, which second end is the functional end. Moreover, as seen from the drawings, the screw driver handle 40 has a hollow chamber 50, generally and preferably of cylindrical configuration. Chamber 50 has a first chamber end 60 and a second chamber end 70, with the first chamber end 60 being the closest to the first end 20 of the screw driver 10, as shown in the drawings. First chamber end 60 of inner chamber 50 is preferably aligned with second chamber end 70 in a longitudinally aligned manner with the longitudinal central axis A-A of the screw driver 10, as seen, however, this positional relationship is not critical to implementation of the subject invention.

The second chamber end 70 of the inner chamber 50, seen as being the lower-most end of the inner chamber 50, as particularly shown in FIG. 1, has a circular opening 90 communicating between the spatial area inside said chamber 50 to spatial areas outside the chamber. Extending longitudinally towards that end 28 of the handle 40 that is nearest to the screw driver shaft 45 is a longitudinally extending hollow cylindrically-shaped first tunnel 95 that communicates with and extends from opening 90 to the end 28 of handle member 40 adjacent to the screw driver shaft 45, as seen. The lower end of first tunnel 95 opens at circular opening 105 near end 28 in handle 40 that communicates to spatial areas outside of the handle member 40.

As can be observed from FIG. 1, the screw driver shaft 45 is formed as a hollow member with a hollow cylindrically-shaped second tunnel 110 extending completely through the length of the shaft 45, even though that portion of the screw driver shaft 45 extends inside the first tunnel 95 of the screw driver handle 40, as can be seen in FIG. 1. It is not critical to the subject invention that the first tunnel member 95 or the second tunnel member 110 be cylindrical, as other shapes may be used. More particularly, the screw driver shaft 45 is inserted in the first tunnel 95 of the handle member 40 so that the first shaft end 120 of the screw driver shaft 45 is positioned immediately adjacent the opening 90 to the hollow inner chamber 50 in the screw driver handle member 40, as seen in the drawings.

In this latter positional relationship, an opening 150 in and to the second tunnel 110 of the screw driver shaft 45 is positioned concentrically adjacent to the opening 90 in the inner chamber 50 of the screw driver handle 40, as can be observed. By this latter relationship, the inner chamber 50 of the handle member 40 communicates directly with the second tunnel 110 of the shaft 45 such that there is a continuous inner spatial area extending from the second chamber end 70 completely through and to the second end 155 of the screw driver shaft at which portion there is an opening 160 that communicates to spatial areas outside of the screw driver shaft 45 and thus outside of the screw driver 10 itself. It is to be noted that the working end of the subject screw driver 10 is that end of the screw driver that is adjacent to and superimposed on the second end 155 of the screw driver 10, as more fully described below.

Disposed within the internal chamber 50, as well as the second tunnel 110 of the screw driver 45, are a plurality of longitudinally extending rod members 200A, 200B . . . 200J. These longitudinally extending rod members 200A, 200B . . . 200J may vary in number, shape and length from embodiment to embodiment, depending on the size of the screw driver structure and the precise configuration and needs thereof. While there are forty-nine such rod members shown in FIG. 1 of the drawings, it is to be stressed that there may be necessarily more, or in same cases less, for implementation of the subject invention and the use of ten such rods in such drawing is only illustrative for the principle of this invention. Each such rod member 200A, 200B, 200C and 200J has a first rod end 210A, 210B . . . 210J and a second rod end 220A, 220B . . . 220J. The first rod end 210A, 210B . . . 210C . . . 210J of each rod member has a perpendicular extension end 240A, 240B . . . 240J, each such perpendicular extension end is perpendicular to the longitudinal extending shank of the respective rod member to which it is affixed in the L-shaped or perpendicular manner as seen in the drawings. The distal ends 250A, 250B . . . 250J of the perpendicular extension ends 240A, 240B . . . 240J are embedded or otherwise affixed in the sides of the chamber 50 in the preferred embodiment. By this latter arrangement the perpendicular extension ends affix the rod members 200A, 200B . . . 200J into the chamber 50. It is to be noted that the distal ends 250A, 250B, 200C and 250J of the perpendicular extension members are the only portions of the rod members 200A, 200B . . . 200J that are affixed to any portion of the screw driver member 10.

More particularly, as can be seen in the drawings, the distal ends 250A, 250B, 250C . . . 250J of the extension members are integrally embedded into the side walls of the chamber 50 so as to permanently secure and anchor the rod-like members into the surrounding side walls of the chamber 50 in the handle member, and by this latter arrangement the respective rod members 200A, 200B, 200C . . . 200J by nature of their flexible wire composition are flexibly mounted inside the chamber 50 and tunnel 110 so as to be able to be moved up and down in a limited manner within the hollow chamber 110 from the second rod ends 220A, 220B . . . 220J. As can be seen from the drawings, each rod member 200A, 200B . . . 200J other that the perpendicular extension portion, 240A, 240B . . . 240J extends longitudinally through the entire extent of the hollow chamber 50 in the handle and the hollow tunnel 110 in the shaft, and the extreme second ends 220A, 220B, 220C . . . 220J project outwardly from the second end 30 of the shaft as shown, by a limited distance. Alternately stated, each longitudinally extending rod member 200A, 200B . . . 220J has a first rod end 210A, 210B . . . 210J, an intermediate perpendicular portion 240A, 240B . . . 240J and a second rod end 220A, 220B . . . 220J. As can be seen in the drawings, and particularly FIG. 1, the first end 210A, 210B . . . 210J of each rod member 200A, 200B . . . 200J is anchored and otherwise secured into the side walls of the internal chamber 50 in the handle member 40.

As stated above, the intermediate angled portion of each rod member 200A, 200B, 200C and 200D is that part of each rod member that is disposed at a ninety degree angle to the longitudinally extending portion of each rod member or substantially close thereto, and which defines and forms the perpendicular bend by which the remaining portion of each rod member is angled in a perpendicular manner to the remaining longitudinal portion of each rod member. Furthermore, as observed in the drawings, the intermediate angled portion of each rod member is located within the internal chamber of the handle member, as shown. By this latter arrangement the first ends 210A, 210B, 210C . . . 210J serve as pivotal focal points by which the rod members 200A, 200B . . . 200J can move back and forth in a limited, but resistant longitudinal movement within the chamber and internal tunnel 110 in the screw driver 10.

As can be seen from the drawings, the longitudinally extending portion of each of the longitudinally extending rod members 200A, 200B . . . 200J extend along with all other longitudinally extending portions of the rod members, lengthwise through the chamber 50 and thence through the opening 90 at the second chamber end and thence further through the hollow chamber 110 in the shaft 45 and thence extend out a limited distance beyond the opening 160 of said inner chamber 110 at the second shaft end, of the screw driver 10. More particularly, the second rod ends 220A, 220B, . . . 220J being the most distal ends of the rod members, extend a limited distance beyond the opening 160 located on the second end 30 of the screw driver 10. Those portions of the rod members 200A, 200B . . . 200J extending beyond the second end of the screw driver 10 function as the working end of the screw driver 10. More particularly, the distan or second ends 220A, 220B . . . 220J of the rod members 200A, 200B . . . 200J serve in lieu of a fixed and solid screw driver blade, as a flexible and variable working end that is adapted to be inserted into all types of screw driver heads, as shown in the drawing. Specifically, the rod members 200A, 200B . . . 200J are affixed inside the internal chamber 50 of screw driver 10 so that each such rod member can move a limited longitudinal and axial distance back and forth in the internal chamber 50 and hollow tunnel 110 of the screw driver member 10.

Figure 6:
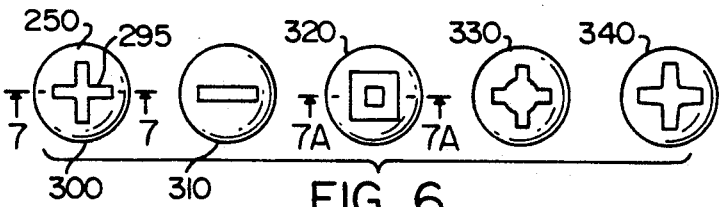
FIG. 6 shows alternate top elevational views of screw heads on which the subject screw driver can be used.
Figure 7:
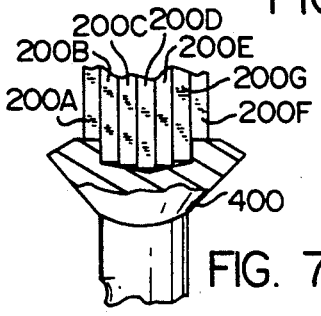
FIG. 7 is a side elevational view in section, showing how the ends of the rod members in the internal chamber of the subject screw driver are inserted in a screw driver head.
Figure 7A:
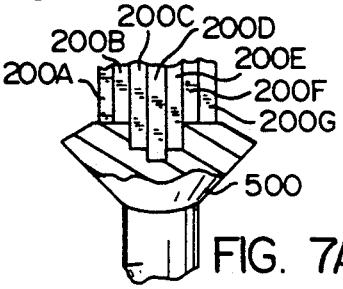
FIG. 7A is a side elevational view of yet another type of screw driver head in which the ends of the rod members are shown as penetrating for manipulation of the screw by the subject screw driver.
Figure 8:
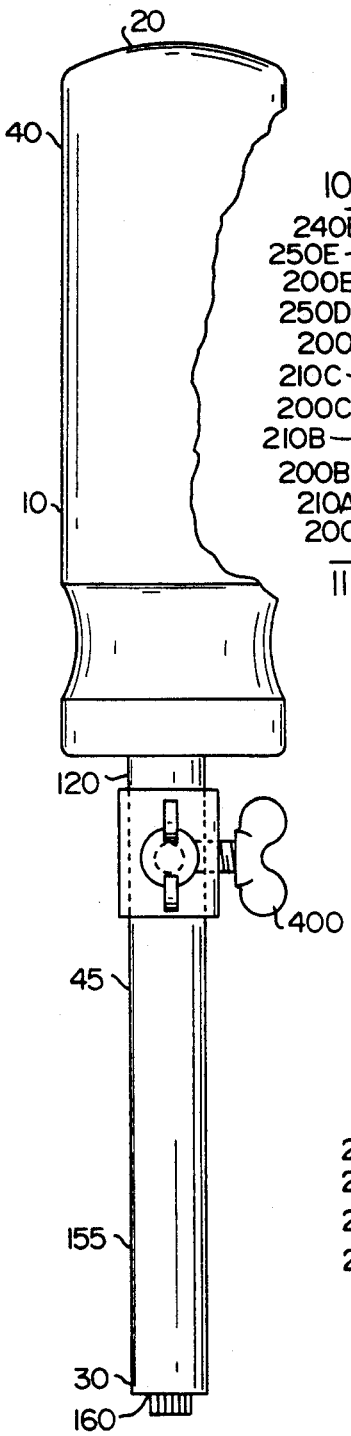
FIG. 8 is a side elevational view of the subject screw driver.
Figure 9:
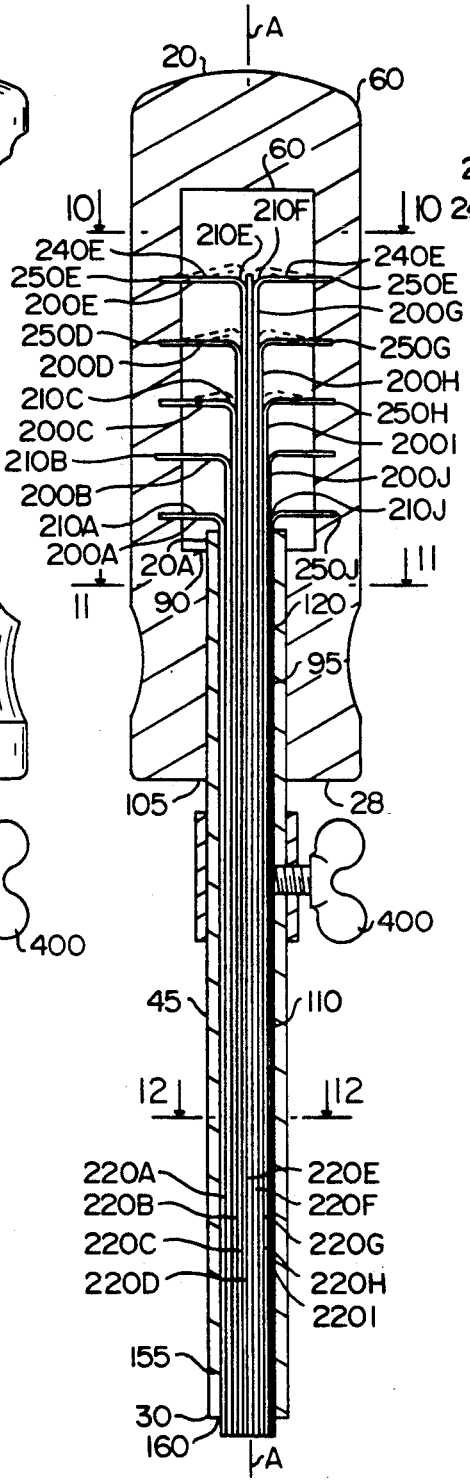
FIG. 9 is a side elevational view, in cross sectional configuration, showing structural arrangement of the rod members in the screw driver.
Figure 10:
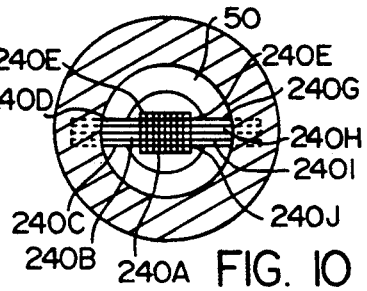
FIG. 10 is a cross sectional view of the subject screw driver handle through the sectional line 10—10 of FIG. 9.
Figure 11:
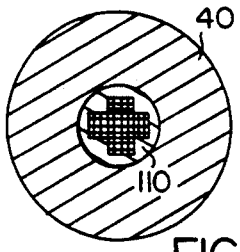
FIG. 11 is a cross sectional view of the handle assembly of the subject screw driver through the sectional line 11—11 of FIG. 9.
Figure 12:
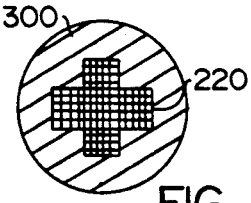
FIG. 12 is a cross sectional view, in a top elevational view perspective of the screw assembly showing penetration of the ends of the rod members in the screw slots.
Figure 13:
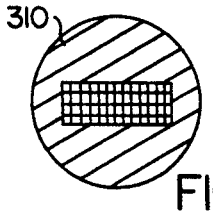
FIG. 13 shows an elevational, cross sectional view, of a single slot screw head showing how the ends of the rods penetrate the slot of screw head.

By this latter arrangement, the extreme lower ends of rod members 200A, 200B, 200C . . . 200J can move back and forth relative to one another a limited distance so as to permit one or more rod member ends to seek its own level or extension depth into the head of a screw or other similar fastener. For instance, in the case of a Phillips (trademark) screw, for example, the ends of the rod members that are adjacent or close to the openings 290 and 295 in the screw head 300, as seen in FIG. 6, will move down into the cavities and engage in said slot cavities to help in turning the screw head 300 with screw driver 10. On the other hand, the rod ends that are not located immediately over a slot opening in the screw head 300 will rise to a level above the bottoms of the slots and rest instead on the uppermost surface 310 portion of the screw head that has no slot. The exact level rod member seeks will depend on the type and size of the screw head involved.

In an alternate embodiment of the subject invention, a thumb screw 400 is affixed concentrically around shaft 45 to tense the rod members in place with the internal shaft 110 in shaft 45.

In summary, the subject invention is a screw driver having a flexible working end, such screw driver comprising in combination a handle member, such handle member having an inner hollow chamber disposed inside such handle member, and further comprising a shaft member mounted to such handle member, such that such shaft member extends from such handle member, and wherein such shaft member has an internal chamber extending completely through such shaft member, and wherein such internal chamber in such shaft member communicates with the internal chamber in such handle member, and further comprising a plurality of flexible rod members, each having a first end and a second end integrally affixed within such internal chambers of such handle member and such shaft member with such second ends of such rod members extending out of the second end of such shaft member a limited distance, such rod ends functioning as the working end of such screw driver.

Yet another summary of the subject invention includes a screw driver with a working head comprising a handle member, having containment means, and a shaft member having containment means, and affixed to the handle member as an extension of such handle member, such shaft member having an opening on a portion thereof, and a plurality of flexible rod members with first ends and second ends affixed on their respective first ends in the containment means in such handle members as well as the containment means in such shaft member, and wherein the second ends of such rod members project outwardly a limited distance from the opening in the shaft member, and which rod ends function as the working head of the screw driver.

In further summary, the subject invention is a screw driver having a flexible working head end, such screw driver comprising a handle member, such handle member having a first inner hollow chamber disposed inside such handle member, and a shaft member mounted to such handle member having a first end and a second end, such that such shaft member extends axially from such handle member, and wherein such shaft member has a second internal chamber extending completely through such shaft member in a longitudinally axial manner, and wherein such internal chamber in such shaft member communicates with the internal chamber in such handle member, and a plurality of flexible rod members, each movable in a limited longitudinal movement, each of such rod members having a first end and a second end affixed within such respective first and second internal chambers of such handle member and such shaft member respectively with such respective second ends of such rod members extending out of the second end of such shaft member a limited distance, such rod ends functioning as the working end of such screw driver.

Yet another summary of the subject invention is a screw driver with a working head comprising a handle member, and a shaft member having containment means and affixed to the handle member as an axial extension of such handle member, such shaft member having an opening on a portion thereof, and further comprising a plurality of flexible rod members with first ends and second ends affixed on their respective first ends in the containment means in such handle members as well as the containment means in such shaft member, and wherein the second ends of such rod members project outwardly a limited distance from the opening in the shaft member, and which rod ends function as the working head of the screw driver.

Another summary of the subject invention includes a screw driver having a variably movable working end, such screw driver comprising a handle member for facilitating rotation of the screw driver and a shaft member having a first end and a second end mounted to such handle member such that said shaft member extends from such handle member in an axial manner, and wherein such shaft member having an internal chamber extending through a portion of such shaft member, and wherein such internal chamber, and further comprising a plurality of flexible rod members, each having a first end and a second end integrally affixed within such internal chambers of such shaft member with such second ends of such rod members extending out of the second end of said shaft member a limited distance, such rod ends functioning as the working end of such screw driver.

Still another summary of the subject invention includes a screw driver with a working head comprising a handle member having containment means, and a shaft member having a first end and a second end having containment means and affixed to the handle members as an extension of such handle member, such shaft member having an opening on a portion of the second end thereof, and a plurality of flexible rod members with first ends and second ends affixed on their respective first ends in the containment means in such shaft members and wherein the second ends of such rod members project outwardly a limited distance from the opening in the shaft member, and which rod ends function as the opening in the shaft member, and which rod ends function as the working head of the screw driver.

I claim:

1. A screw driver having a flexible working end, said screw driver comprising:

(a) a handle member, said handle member having an inner hollow handle chamber disposed inside said handle member;

(b) a shaft member with a first end and a second end, said shaft member being mounted to said handle member, such that said shaft member extends from said handle member, and wherein said shaft member has an internal shaft chamber, with a first end and a second end, extending completely through said shaft member, and wherein said internal shaft chember in said shaft member communicates with the internal handle chamber in said handle member;

(c) a plurality of flexible rod members, each of said rod members having a first end and a second end, said first end of each said rod member being integrally affixed within said internal handle chamber of said handle member with the remaining portion of each said rod member extending longitudinally through both the internal handle chamber and the internal shaft chamber with said second end of each said rod member extending out of the second end of said shaft chamber a limited distance, each said second end of each rod member functioning as the working end of such screw driver.

2. A screw driver with a working head comprising:

(a) a handle member, having internal handle containment means, said handle containment means having an internal wall;

(b) a shaft member with a first end and a second end and having internal shaft containment means with said shaft member being affixed to the handle member as an extension of said handle member, said shaft member having an opening on the second end thereof;

(c) a plurality of flexible rod members with first ends and second ends, wherein each of said rod members has longitudinally extending shaft portions, said rod members being affixed on their respective first ends in the handle containment means and wherein said rod members extend longitudinally from their respective first ends through the handle containment means and completely through the shaft containment means and wherein the second ends of said rod members project outwardly a limited distance from the opening on the second end in the shaft member, and which rod second ends of said rod members function as the working head of the screw driver, and further wherein said rod first ends of said rod members are formed as perpendicular extensions to the longitudinally extending shaft portions of said rod members, and wherein said perpendicular extensions are integrally affixed to the internal wall of the handle containment means.

3. A screw driver having a flexible working head end, said screw driver comprising:

(a) a handle member, said handle member having a first inner hollow chamber disposed inside said handle member;

(b) a shaft member mounted to said handle member having a first end and a second end, such that said shaft member extends axially from said handle member, and wherein said shaft member has a second internal chamber extending completely through said shaft member in a longitudinally axial manner, and wherein said internal chamber in said shaft member communicates with the inner hollow chamber in said handle member;

(c) a plurality of flexible rod members, each movable in a limited longitudinal movement, each of said rod members having a first end and a second end, said first end being affixed within said respective first inner hollow internal chamber of said handle member respectively with said respective second ends of said rod members extending out of the second end of said shaft member a limited distance, said rod ends functioning as the working end of such screw driver, and further wherein each of the flexible rod members are provided with perpendicular extensions, the ends of which are affixed in a flexible manner inside the first inner hollow chamber of said handle member.

* * * * *